United States Patent [19]

Schleicher

[11] Patent Number: 4,674,705

[45] Date of Patent: Jun. 23, 1987

[54] ARRANGEMENT FOR AERODYNAMICALLY BRAKING THE ROTATIONAL MOVEMENT OF A BODY

[75] Inventor: Ulrich Schleicher, Hersbruck, Fed. Rep. of Germany

[73] Assignee: DIEHL GmbH & Co., Nuremberg, Fed. Rep. of Germany

[21] Appl. No.: 739,971

[22] Filed: May 31, 1985

[30] Foreign Application Priority Data

Jun. 15, 1984 [DE] Fed. Rep. of Germany ..... 3422231

[51] Int. Cl.[4] ..... F42B 15/02

[52] U.S. Cl. ..... 244/3.1

[58] Field of Search ..... 244/3.1

[56] References Cited

U.S. PATENT DOCUMENTS

| | | | |
|---|---|---|---|
| 3,229,930 | 1/1966 | Fedor et al. | 244/3.1 |
| 3,277,486 | 10/1966 | Kuebler | 244/3.1 |
| 3,715,092 | 2/1973 | Moyer et al. | 244/3.1 |
| 4,350,315 | 9/1982 | Pollin | 244/3.1 |
| 4,411,398 | 10/1983 | Wedertz et al. | 244/3.28 |
| 4,436,259 | 3/1984 | Schmidt et al. | 244/3.1 |

FOREIGN PATENT DOCUMENTS

| | | |
|---|---|---|
| 2226123 | 1/1973 | Fed. Rep. of Germany . |
| 2757141 | 7/1978 | Fed. Rep. of Germany . |
| 3301784 | 8/1983 | Fed. Rep. of Germany . |
| 3400083 | 8/1984 | Fed. Rep. of Germany . |
| 2260772 | 9/1975 | France . |
| 745252 | 2/1956 | United Kingdom . |
| 1181136 | 2/1970 | United Kingdom . |
| 1527971 | 10/1978 | United Kingdom . |
| 2059023 | 4/1981 | United Kingdom . |
| 2149481 | 6/1985 | United Kingdom . |

OTHER PUBLICATIONS

Fedor, J. V., "Theory and Design Curves for a Yo-Yo De-Spin Mechanism for Satellites"; Aug. 1961.

*Primary Examiner*—Charles T. Jordan

*Attorney, Agent, or Firm*—Scully, Scott, Murphy & Presser

[57] ABSTRACT

An arrangement for aerodynamically braking the rotational movement of a body, especially a secondary or subordinate ammunition member which is ejected from its carrier, through the utilization of flexible braking surface elements which are articulated to the wall of the body so as to be swingable outwardly. A flexible braking surface of that type can be simply configured as a sheet metal plate or fabric which is pliantly bendable in every direction, which allows it to be slung about the wall of the member so as to closely lie thereagainst, and thereby protrudes only slightly; but which, on the other hand, because of its weight (and at times through a weight exerting a centrifugal force, which is additionally attached at its end) will dependently and rapidly unfold when there is released its restraint from its initially rolled-up condition; for example, when the member is to be expelled from its built-in position within a carrier.

5 Claims, 2 Drawing Figures

FIG. 1
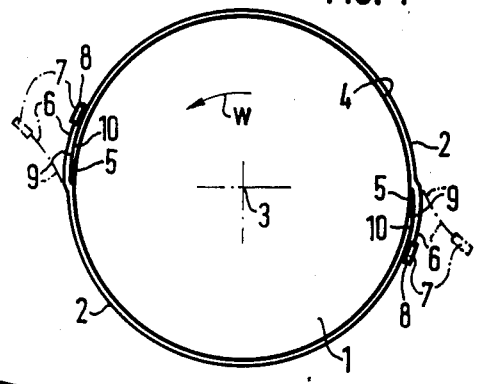
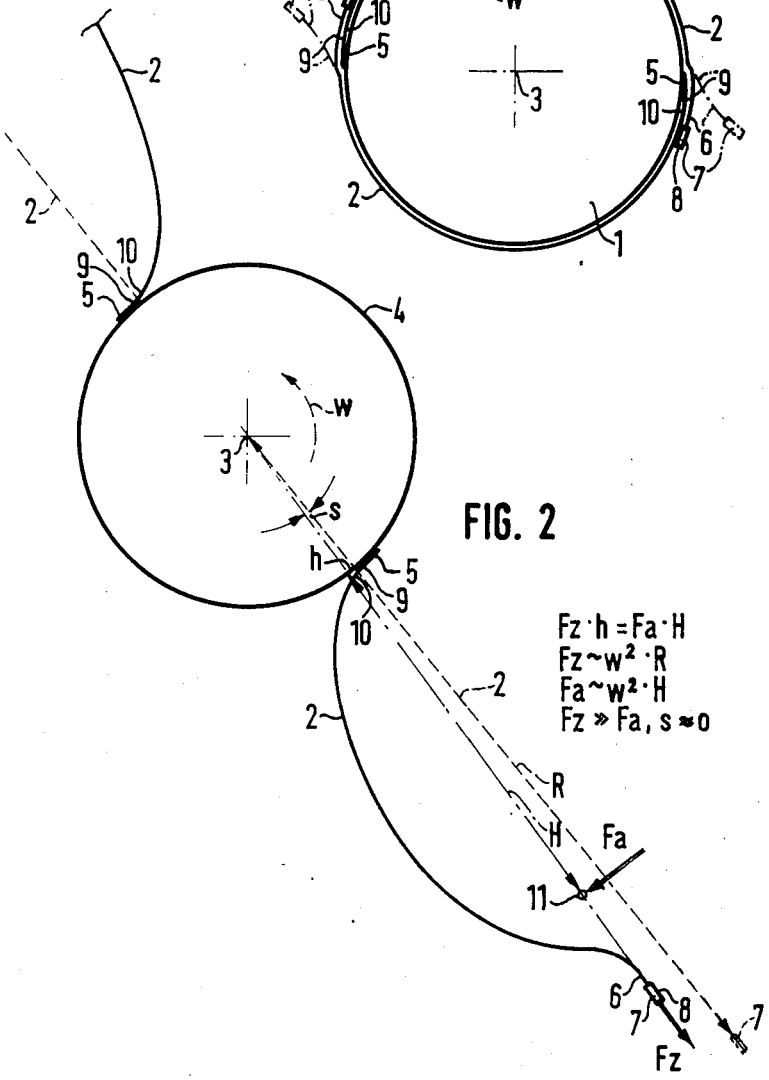
FIG. 2
$Fz \cdot h = Fa \cdot H$
$Fz \sim w^2 \cdot R$
$Fa \sim w^2 \cdot H$
$Fz \gg Fa, s \approx 0$

ARRANGEMENT FOR AERODYNAMICALLY BRAKING THE ROTATIONAL MOVEMENT OF A BODY

BACKGROUND OF THE INVENTION

1. Field of the Invention

The present invention relates to an arrangement for aerodynamically braking the rotational movement of a body, especially a secondary or subordinate ammunition member which is ejected from its carrier, through the utilization of braking surface elements which are articulated to the wall of the body so as to be swingable outwardly.

2. Discussion of the Prior Art

A subordinate ammunition member of that type is described in the introductory portion of German Laid-Open patent application No. 27 57 141. In that disclosure there is represented that prohibitive constructional hindrances stand in the way of the practical implementation of radially shaped outwardly spreadable braking surfaces; in particular to the extent in that the wall structure of the cylindrical member encompasses an active charge, and which for the effective utilization thereof against an attacked target will not allow for any constructive modifications of the kind as would be required for the support of rigid braking flaps, with the formation of frictional moments for the reduction of the moving energy during the swinging out of such braking surface elements. On the other hand, the measures which are proposed in that publication for circumventing these difficulties, relating to the braking of the rotational movement of the projectile, are disadvantageous in connection with the demands placed on manufacture and assembling; and the displacement of the braking surfaces proposed therein into their operative position does not appear to be sufficiently secure against troublesome disturbances.

SUMMARY OF THE INVENTION

Accordingly, in recognition of the shortcomings of the prior art, it is an object of the present invention to provide an arrangement of the above-mentioned constructional type, which distinguishes itself through a simple and consequently compact structure at a high operational dependability which is not susceptible to difficulties.

The foregoing object is essentially attained, pursuant to the invention, through the constructive arrangement for aerodynamically braking the rotational movement of a body through the intermediary of flexible braking surfaces which represent weights exerting a centrifugal force relative to their articulated connections.

A flexible braking surface of that type can be simply configured as a sheet metal plate or fabric which is pliantly bendable in every direction, which allows it to be slung about the wall of the member so as to closely lie thereagainst, and thereby protrudes only slightly; but which, on the other hand, because of its weight (and at times through a weight exerting a centrifugal force, which is additionally attached at its end) will dependably and rapidly unfold when there is released its restraint from its initially rolled-up condition; for example, when the member is to be expelled from its built-in position within a carrier. Under a somewhat higher constructional requirement, there can be avoided any fluttering phenomena of the braking surfaces, in that they are equipped with rod-shaped weights exerting a centrifugal force, or in that they are only pliantly flexible in a peripheral direction and transversely thereof possess a resistance to bending (in effect, along the direction of the axis of the member). This configuration is obtained, for example, through a constructional shape as cylindrical hollow shells of a resilient material, such as spring plate. In this instance, it can be purposeful to provide the free end of each braking surface element with a protruding prestressing component which deviates from the curvature of the wall, and which facilitates the initiation of the outwardly extending movement after the release of the braking surfaces, which is then completed by the application of the centrifugal force.

Inasmuch as can be indicated, referring to the description hereinbelow, the spread-apart angled position of each of the braking surfaces which is extended and tensioned under the influence of the centrifugal force stands, with respect to its articulated connection to the wall of the member, in a torsional moment equilibrium with the application of the aerodynamic braking force, the articulated connection to the wall need not absorb any kind of support moments since it is only subjected to tension. As a result, there are eliminated any measures which are constructively complex and susceptible to difficulties, in the construction of linkages which are designed for the absorption of the braking or support moments. In contrast therewith, it is adequate to undertake for the connection of the braking surface elements to the member wall, an articulated connection in the form of a simple pivot hinge, or even through only a pliantly flexible intermediate member which is formed integrally with the material of the braking surface element itself (for example, as a woven reinforced material segment) or which, for example, can be separately interconnected in the form of a flexible leather strip. Also the articulated connection of the braking surface element to the wall of the member also barely protrudes beyond the spatial requirements for the member per se, so as to require within the carrier only a minimal additional spatial requirement for the arranging of the braking surface elements in their wrapped condition. Any kind of additional spatial requirement for the arranging of anti-vibration and restraining elements, for limiting of the outwardly swinging movement of the braking surface elements and their extended support subsequent to the release as a consequence of their expulsion from the carrier, can be completely eliminated; inasmuch as such measures, because of the articulated connection of the braking surface elements to the member which is only subjected to tensile loads, and because of the stable-behaving orientation of the braking surface elements under the influence of the torsional moment equilibrium, are now completely obviated.

BRIEF DESCRIPTION OF THE DRAWINGS

Additional embodiments and further modifications, as well as further features and advantages of the invention can now be ascertained from the following detailed description of an exemplary embodiment of the invention, taken in conjunction with the accompanying drawings; in which:

FIG. 1 illustrates an end view of a cylindrical member with braking surface elements which are still positioned to extend along the wall thereof; and FIG. 2 illustrates the member of FIG. 1 with outwardly swung braking surface elements which are curved under the effect of the force of the oncoming aerodynamic flow.

DETAILED DESCRIPTION

The member 1, which is illustrated in FIG. 1 by an end view, preferably relates to a secondary or subordinate ammunition member which can be expelled, for example, from a spin-stabilized fired carrier (not shown in the drawing) over a target area. The packing, in which the member 1 is arranged within its carrier prior to expulsion, necessitates that flexible braking surface elements 2, which are articulated to the cylindrical outer wall 4 in parallel with and symmetrical to the axis 3, initially lie in flat surface contact against this wall 4. The free ends 6 of the braking surface elements 2 which are located opposite the articulated connection 5 (for purposes of clarity there are herein shown only two, however, of which a larger number can be arranged peripherally mutually offset symmetrically relative to the axis 3) are, in this instance, additionally provided with weights 7 exerting a centrifugal force. For instance, these weights 7 can be rod-shaped, in essence extending in parallel with the axis 3, and enclosed in stiff case-like loops 8 on the ends 6 of the braking surface elements, in effect, retained therein. However, the arrangement can also relate to discretely positioned, mutually offset individual weights 7 located along the edge of the free end 6 of the braking surface element; even when the weight distribution along the braking surface element 3 (with a resultant center of gravity of the weight located sufficiently distant from the articulated connection 5) would not provide an adequate centrifugal force. When the region of the articulated connection 5 is somewhat stronger applied against the wall 4 compared with the strength of the flexible braking surface elements 2, then the peripheral lengths of the braking surface elements 2 are suitably so designed, as considered in FIG. 1, that similarly more strongly applied additional weights 7 on the ends 6 of the braking surface elements, will not lie directly on but rather (viewed peripherially) in front of or behind an articulated connection 5. The articulation 5 itself can be constructed as a rotary linkage-pivot hinge; however, as illustrated, it is sufficient to provide for a connection of the braking surface elements 2 through pliantly bendable intermediate spacer or web members 9, somewhat in the form of a leather strip which, on the one end (by riveting or adhesive bonding) is fastened to the wall 4, and on the other end is fastened along the adjoining edge 10 of the therewith associated braking surface element 2. When the flexible braking surface elements 2 are constituted of a fabric material, for example, of a metal fabric, textile fabric, or plastic fabric, then in the region of its edge 10 they can also be directly formed as the pliantly bendable intermediate spacer member 9, for instance, through a reinforced fabric strip in the area of its connection to the wall 4.

However, the flexible braking surface elements 2 need not be constructed as fabric surface elements (sail cloth) which are pliantly bendable in every direction; as set forth hereinbelow, it can also be advantageous to employ flexible braking surface elements 2 which are pliantly bendable and resiliently elastic in the direction of the extent of curvature of the wall 4; but resistant to bending transverse to this direction; for example, constructed as hollow cylindrical shells constituted of spring plate. Also in this instance it is purposeful to provide the free end 6 with a weight 7 exerting a centrifugal force, and the transitional region ahead thereof, as illustrated in FIG. 1 by phantom-lines, with a prestressing which protrudes from the wall 4, so that the braking surface elements 2 will, in the region of their ends 6 will extend in this direction and rapidly raise away from the wall 4, as soon as they are freed from their forced packing position (assumed in FIG. 1) upon exiting from their carrier.

After the expulsion from the carrier, any rotational movement w of the member 1 should be attenuated as rapidly as possible down to a residual value so that it will move dynamically stable but only slowly rotating, to presently drop into the target area along the direction of its axis 3. Serving to provide that aerodynamic braking of the initial rotational movement w are the flexible braking surface elements 2.

Every flexible surface element 2 extends inself laterally, after elimination of the restraint within the carrier, the centrifugal force $F_z$ which essentially acts on its weight 7, causes the braking surface element 2 to be radially outwardly tensioned, as is indicated in FIG. 2 by the phantom-line orientation. This beamlike or ray-shaped extension is however not attained when an aerodynamic braking force $F_A$ becomes effective which is directed tangentially opposite to the direction of the rotational movement w; such as is symbolically indicated in FIG. 2 as a force integral over the applicating surface in the effective center of gravity 1 of the braking surface. The application of this braking force $F_a$ leads to a curving of the braking surface element 2 (shown exaggerated in FIG. 2) and to an effective pivoting of the chord line across this curvature (opposite the phantom-illustrated radials) about a smaller pivot angle s in the applicating direction of the braking force $F_a$. This pivot angle s, however, is negligibly small (in a magnitude of less than 10°) particularly when there is assured through a suitable sizing of a weight 7 (and on the other hand, the surface extent over which the braking force $F_a$ applies against the braking surface element 2) that the centrifugal force $F_z$ which tensions the braking surface element 2, is large in comparison with the braking force $F_a$. Applicable thereto is the torsional moment equilibrium, tabulated on the side of FIG. 2, about the articulated connection 5 for the braking surface element. Since the rotational movement w enters at the same power into the centrifugal force $F_z$, as well as into the braking force $F_a$, the geometric shape and angular position of the braking surface element 2 which is achieved under the formation of the torsional moment equilibrium, will remain intact over the desirably occurring drop off in the rotational movement w. Also this system is kinetically stable insofar as, for example, an increase in the braking force $F_a$ caused by surrounding air conditions leads to a more intense bending of the braking surface elements; in essence, to a displacement of the end 6 of the braking surface element towards the articulated connection 5, and as a result to a reduction in the effective aerodynamic applying surface, thus again to a reduction in the previously increasing braking force $F_a$. When, on the other hand, a surrounding airstream acts against the registered braking force $F_a$, which is oriented pursuant to the extent of the rotational movement w, the curvature of the braking surface element 2 then becomes less. The end 6 (additionally loaded by the weight 7) thereby moves outwardly, and the effective applying surface for the reduction in the spinning of the member 1 increases itself, with the result of an again enchanced effective braking force $F_a$ and an increasing braking effect due to the pirouetting effect, which is still further intensified by an outwardly displacing additional weight 7.

At particularly unfavorable dimensions and surrounding influences, it is not possible to completely preclude that the braking surface elements 2 will be streamed against by surrounding airstreams along the direction of the axis 3 or at a small angle relative to this axis 3, which for low weights of the surface elements 2, in effect low centrifugal force-tensile forces, in the case of a braking surface element 2 which is bendable in every direction, can lead to fluttering phenomena, and thereby to an unstable motion behavior of the member 1 and to aerodynamic losses. If necessary, such phenomena can be counteracted in a simple manner when the braking surface elements 2 are not constructed of cloth, but along the direction of the axis 3 are made resistant to bending (for example, as already mentioned hereinabove as hollow cylindrical shells of spring sheet metal or plate). Then it becomes possible to obtain the desired bending of each one of the braking surface elements 2 under the influence of the aerodynamic braking force $F_a$; however, cross currents (generally in the direction of the axis 3) will not lead to offsetting of the braking surface element 2 against the direction of the axially-parallel articulated connection 5; and fluttering phenomena are thus securely avoided.

I claim:

1. In an arrangement for aerodynamically braking the rotational movement of a subordinate ammunition member expelled form a rotating carrier; including braking surface elements axially-parallel articulated to the wall of the member so as to be readily outwardly swingable therefrom; the improvement comprising: each of said braking surface elements including a readily bendable articulated connection for assuming tensile loads acting transversely of the longitudinal axis of said subordinate ammunition member, said flexible braking surface elements being fastened to the wall of said ammunition member axially-parallel to the direction of rotation and assuming bending moments transverse to the direction of the axis, each said braking surface element being formed as a hollow cylindrical shell constituted of a material which is elastically bendable in the direction of the curvature of the wall, and each said element being imparted an elastic prestressing in the region of the free end thereof which is directed opposite the direction of curvature of the wall.

2. Arrangement as claimed in claim 1, wherein the articulated connection comprises a pliantly bendable intermediate spacer means between the wall of the member and the adjacent edge of the braking surface element.

3. Arrangement as claimed in claim 1, wherein the articulated connection comprises a reinforced edge region of a flexible braking surface element constituted of a fabric material.

4. Arrangement as claimed in claim 1, wherein the braking surface elements comprise additional weights exerting a centrifugal force at their free ends.

5. Arrangement as claimed in claim 1, wherein the weights are rod-shaped and are arranged at the ends of the braking surface elements extending in parallel with the member wall.

* * * * *